US009096961B2

(12) United States Patent
Jones et al.

(10) Patent No.: US 9,096,961 B2
(45) Date of Patent: Aug. 4, 2015

(54) NONWOVEN WIPE WITH BONDING PATTERN

(75) Inventors: Mark F. Jones, Statesville, NC (US); Romeo Bregant, Batel, Curitiba (BR); Esteban M. Bregant, Sao Jose dos Pinhais (BR)

(73) Assignee: Providencia USA, Inc., Statesville, NC (US)

( * ) Notice: Subject to any disclaimer, the term of this patent is extended or adjusted under 35 U.S.C. 154(b) by 586 days.

(21) Appl. No.: 13/458,169

(22) Filed: Apr. 27, 2012

(65) Prior Publication Data

US 2013/0288013 A1 Oct. 31, 2013

(51) Int. Cl.

| | |
|---|---|
| ***B32B 3/00*** | (2006.01) |
| ***D04H 1/485*** | (2012.01) |
| ***D04H 3/14*** | (2012.01) |
| ***D04H 5/06*** | (2006.01) |

(52) U.S. Cl.

CPC ..... *D04H 1/485* (2013.01); *D04H 3/14* (2013.01); *D04H 5/06* (2013.01); *Y10T 428/24612* (2015.01)

(58) Field of Classification Search

CPC ..... B32B 3/30; B32B 3/00; B32B 38/06; B32B 7/04; B44C 1/24; D04H 13/007; D04H 3/14; D04H 3/16; B31F 1/07; B31F 2201/0733

USPC ..... 428/156, 171, 172, 198

See application file for complete search history.

(56) References Cited

U.S. PATENT DOCUMENTS

| | | | | |
|---|---|---|---|---|
| 3,616,157 | A | 10/1971 | Smith | |
| 3,855,046 | A | 12/1974 | Hansen et al. | |
| 3,973,068 | A | 8/1976 | Weber | |
| 4,091,137 | A * | 5/1978 | Miller | 428/198 |
| 4,741,941 | A | 5/1988 | Englebert et al. | |
| 5,424,115 | A | 6/1995 | Stokes | |
| 5,858,515 | A | 1/1999 | Stokes et al. | |
| 5,964,742 | A | 10/1999 | McCormack et al. | |
| 6,093,665 | A | 7/2000 | Sayovitz et al. | |
| D463,137 | S | 9/2002 | Monroe et al. | |
| 6,537,644 | B1 | 3/2003 | Turi et al. | |
| 6,610,390 | B1 | 8/2003 | Kauschke et al. | |
| 6,752,947 | B1 | 6/2004 | Lanigan et al. | |
| D516,318 | S | 3/2006 | Hasenoehrl et al. | |

(Continued)

FOREIGN PATENT DOCUMENTS

| | | |
|---|---|---|
| EP | 1322806 | 9/2005 |
| GB | 20310139 A | 8/1978 |

(Continued)

*Primary Examiner* — Catherine A Simone

(74) *Attorney, Agent, or Firm* — Womble Carlyle Sandridge & Rice LLP; Todd M. Hess

(57) ABSTRACT

A nonwoven wipe has multiplicity of fibers, bonded portions, and unbonded portions. The bonded portions are spaced apart from one another, each bonded portion comprises portions of the fibers that are bonded together, and each bonded portion has a thickness extending perpendicularly between opposite faces of the nonwoven wipe. Each unbonded portion comprises portions of the fibers that are not bonded together, and each unbonded portion has a thickness extending perpendicularly between the opposite faces of the nonwoven wipe. The thicknesses of the unbonded portions is greater than the thicknesses of the bonded portions. The bonded portions are sized and arranged for providing a desirable balance of properties.

24 Claims, 2 Drawing Sheets

(56) References Cited

U.S. PATENT DOCUMENTS

| | | | |
|---|---|---|---|
| D516,319 | S | 3/2006 | Hasenoehrl et al. |
| 7,914,723 | B2 | 3/2011 | Kim et al. |
| 2003/0041953 | A1 | 3/2003 | Farell et al. |
| 2004/0241399 | A1 | 12/2004 | Marmon et al. |
| 2005/0148260 | A1 | 7/2005 | Kopacz et al. |
| 2005/0159063 | A1 | 7/2005 | Hill et al. |
| 2005/0241088 | A1 | 11/2005 | Brunner et al. |
| 2006/0063456 | A1 | 3/2006 | Carter |
| 2007/0130713 | A1 | 6/2007 | Chen et al. |
| 2008/0182048 | A1 | 7/2008 | Ouellette et al. |

FOREIGN PATENT DOCUMENTS

| | | |
|---|---|---|
| WO | WO 9827257 | 6/1998 |
| WO | WO 9855295 | 12/1998 |
| WO | WO 2002/048440 | 6/2002 |
| WO | WO 2006004871 | 1/2006 |
| WO | WO 2008066417 | 6/2008 |

* cited by examiner

NONWOVEN WIPE WITH BONDING PATTERN

BACKGROUND

The present invention relates to nonwoven fabrics and, more particularly, to thermally bonded nonwoven wipes.

SUMMARY

One aspect of this disclosure is the provision of a nonwoven wipe comprising a multiplicity of fibers; a plurality of bonded portions, the bonded portions being spaced apart from one another, each bonded portion comprising portions of the fibers that are bonded together, and each bonded portion having a thickness extending perpendicularly between opposite faces of the nonwoven wipe; a plurality of unbonded portions, each unbonded portion comprising portions of the fibers that are not bonded together, and each unbonded portion having a thickness extending perpendicularly between the opposite faces of the nonwoven wipe; the thicknesses of the unbonded portions being greater than the thicknesses of the bonded portions; and the bonded portions being sized and arranged in a predetermined manner. For example, the bonded portions may be sized and arranged in a predetermined manner for providing a desirable balance of properties of the nonwoven wipe.

The bonded portions may be sized and arranged in a pattern configured so that the unbonded portions occupy more than 5.55 times, or more than about 6 times, as much space as the bonded portions in a plan view of an area of a face of the opposite faces of the nonwoven wipe, wherein the area contains more than one hundred of the bonded portions. A variety of bonding patterns are within the scope of this disclosure.

The fibers may be, but are not limited to, meltspun filaments and/or staple fibers cut from meltspun filaments, and the bonded portions may comprise portions of the fibers that are thermally fused together.

The thicknesses of the unbonded portions may be more than twice as large as the thicknesses of the bonded portions.

Exterior surfaces of the bonded portions may be recessed relative to exterior surfaces of the unbonded portions at each of the opposite faces of the nonwoven wipe.

The unbonded portions may be contiguous with one another in the nonwoven wipe. The opposite faces of the nonwoven wipe may be opposite exterior faces of the nonwoven wipe, and the nonwoven wipe may be a single ply nonwoven wipe.

The nonwoven wipe may have a basis weight of at least about fifty five grams per square meter, or at least about sixty grams per square meter. The nonwoven wipe may have a basis weight of less than one hundred grams per square meter.

In accordance with one aspect of this disclosure, a nonwoven wipe consists essentially of a multiplicity of fibers (e.g., staple fibers and/or filaments); a plurality of bonded portions, each bonded portion consisting essentially of portions of the fibers that are thermally fused together; and a plurality of unbonded portions, each unbonded portion consisting essentially of portions of the fibers that are not bonded together, wherein the bonded portions are spaced apart from one another, each bonded portion has a thickness extending perpendicularly between opposite faces of the nonwoven wipe, each unbonded portion has a thickness extending perpendicularly between the opposite faces of the nonwoven wipe, the thicknesses of the unbonded portions are greater than the thicknesses of the bonded portions, the bonded portions are sized and arranged in a pattern configured so that the unbonded portions occupy more than 5.55 times, or more than about 6 times, as much space as the bonded portions in a plan view of an area of a face of the opposite faces of the nonwoven wipe, and the area contains more than one hundred of the bonded portions. The fibers may be meltspun filaments and/or staple fibers cut from meltspun filaments.

A nonwoven fabric may be a precursor to the nonwoven wipes, and one aspect of this disclosure is the provision of the nonwoven fabric, with or without nonwoven wipes being formed (e.g., cut or torn) from the nonwoven fabric.

The foregoing presents a simplified summary of some aspects of this disclosure in order to provide a basic understanding. The foregoing summary is not extensive and is not intended to identify key or critical elements of the invention or to delineate the scope of the invention. The purpose of the foregoing summary is to present some concepts of this disclosure in a simplified form as a prelude to the more detailed description that is presented later. For example, other aspects will become apparent from the following.

BRIEF DESCRIPTION OF THE DRAWINGS

Having described some aspects of this disclosure in general terms, reference will now be made to the accompanying drawings, which are schematic and not necessarily drawn to scale. The drawings are exemplary only, and should not be construed as limiting the invention.

DETAILED DESCRIPTION

Exemplary embodiments are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention.

Figure 1:
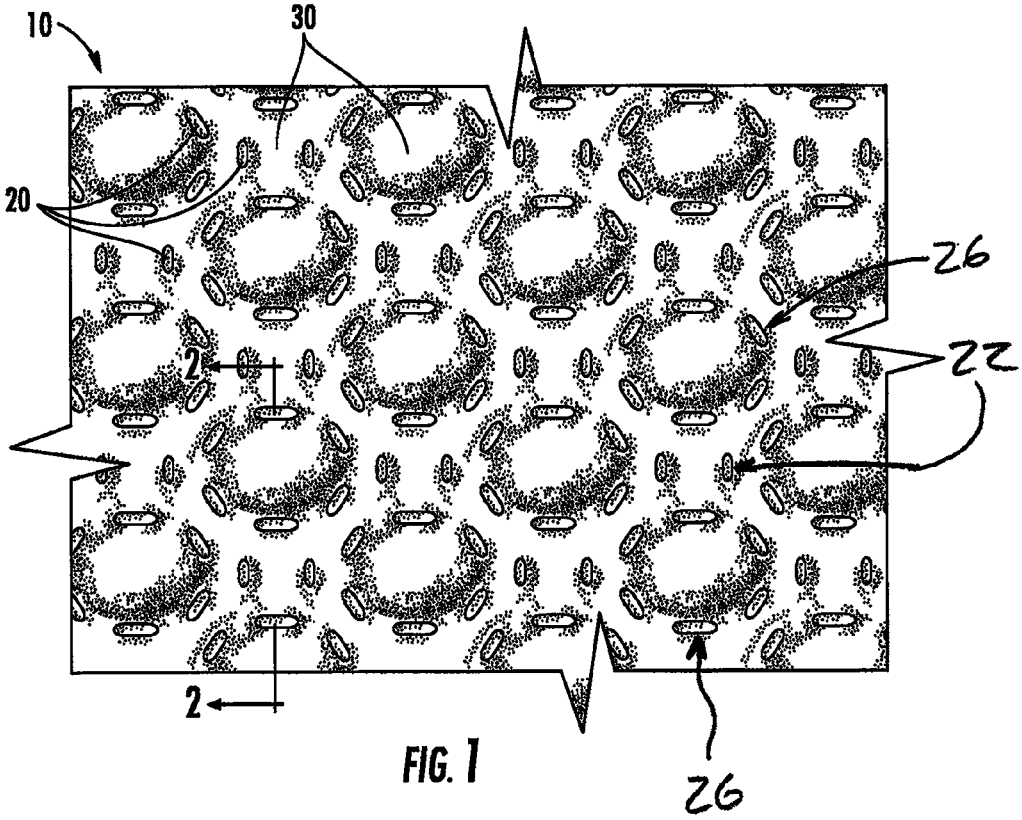
FIG. 1 is an enlarged plan view that is illustrative of each of the opposite exterior faces of a spunbond nonwoven fabric, or more specifically a spunbond nonwoven wipe, in accordance with an exemplary embodiment.

Referring in greater detail to the drawings, a thermally bonded nonwoven fabric, or more specifically a spunbond nonwoven fabric 10, or even more specifically a spunbond nonwoven wipe of an exemplary embodiment is shown in FIG. 1. The nonwoven fabric or wipe 10 is a nonwoven web of a multiplicity of thermoplastic meltspun filaments (e.g., see filaments 44 in FIG. 3) that are held together at discrete bonded portions 20 of the nonwoven web. For example, there may be as few as 100 or up to in excess of 500 meltspun filaments in a piece of the nonwoven fabric or wipe 10 that is one inch long and one inch wide. Each of the bonded portions 20 of the nonwoven fabric or wipe is an area in which portions of the meltspun filaments are bonded together, or more particularly thermally fused together. In each of the bonded portions 20 of the exemplary embodiment, a vast majority of the portions of the meltspun filaments are thermally fused together, as will be discussed in greater detail below. The bonded portions 20 typically, but not necessarily, have rounded edges.

In the specific nonwoven fabric or wipe 10 shown in FIG. 1, each of the bonded portions 20 is oblong, and only a representative few of the bonded portions are identified with their reference numeral. More specifically, each of the bonded portions 20 is obround, or substantially obround. Even more specifically, each of the bonded portions may have, or may approximately have, opposite semicircular ends connected by parallel sides that are respectively tangent to the endpoints of the semicircular ends. Notwithstanding, a variety of differently shaped bond portions 20 are within the scope of this invention.

The bonded portions 20 are discontinuous and spaced apart from one another so that the nonwoven web of the nonwoven fabric or wipe 10 has unbonded portions 30, and the unbonded portions are contiguous with one another. Only a representative few of the unbonded portions 30 are identified with their reference numeral in FIG. 1. Alternatively, at least some of the unbonded portions 30 may be discontiguous with respect to one another.

In the exemplary embodiment, it may be the case that none of the meltspun filaments (e.g., see filaments 44 in FIG. 3) are bonded together, or more particularly none of the meltspun filaments are fused together, within each of the unbonded portions 30. That is and typically, at least a vast majority of the portions of the meltspun filaments are not fused or otherwise bonded together in each of the unbonded portions 30.

In the exemplary embodiment, ratios between the bonded and unbonded portions 20, 30 optimize the moisture retention capability of the nonwoven fabric or wipe 10 while maintaining other desirable physical properties of the nonwoven such as, but not limited to, fabric bulk, drapability, elongation, tensile strength, porosity, and softness. For example and as shown in FIG. 1, the unbonded portions 30 occupying significantly more of the nonwoven web than the bonded portions 20. More specifically, the unbonded portions 30 occupy multiple times more of the nonwoven web 10 than the bonded portions 20 in a plan view of the faces of the nonwoven fabric or wipe 10. In such a plan view, the ratio of the cumulative area of the unbonded portions 30 to the cumulative area of the bonded portions 20 is typically greater than 5.55 to 1, greater than about 6 to 1, greater than about 7 to 1, or about 7.14 to 1, or greater than about 7.14 to 1. In such a plan view, the ratio of the cumulative area of the unbonded portions 30 to the cumulative area of the bonded portions 20 may be in a range from greater than 5.55:1 to about 9:1, or any other suitable range, such as any suitable range within the range from greater than 5.55:1 to about 9:1, such as from about 6:1 to about 8:1.

Figure 2:
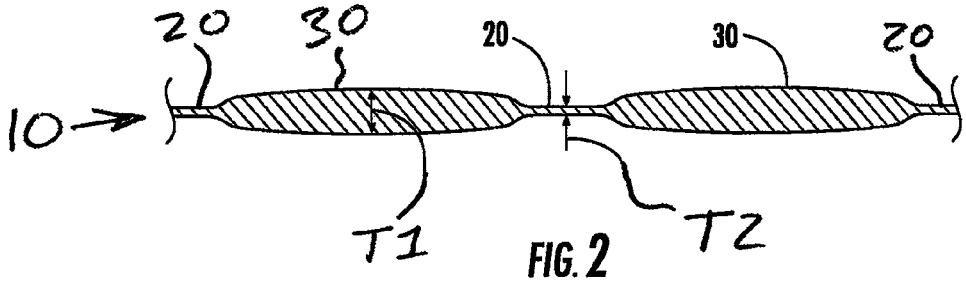
FIG. 2 is an enlarged cross-sectional view taken along line 2-2 of FIG. 1, wherein only the cross section is shown.

As another example and as representatively shown in FIG. 2, each of the unbonded portions 30 have loft. FIG. 2 is schematic because, for example, the loftiness may be exhibited more on one side of the nonwoven fabric or wipe 10 than the other. Regarding the loftiness and as shown in FIG. 2, each of the unbonded portions 30 has a relatively large thickness T1, and each of the bonded portions 20 has a relative small thickness T2. More specifically, the ratio of the relatively large thickness T1 to the relatively small thickness T2 is typically greater than 3:1, greater than 4:1, greater than 5:1, or greater than 6:1.

As a further example and as may also be understood with reference to FIG. 2, the exterior surfaces of the bonded portions 20 may be recessed relative to the exterior surfaces of the unbonded portions 30 at each of the opposite faces of the nonwoven web 10. FIG. 2 is schematic because, for example, the recessed nature of the bonded portions 20 may be exhibited more on one side of the nonwoven fabric or wipe 10 than the other. Because the bonded portions 20 are spaced apart from one another, recessed relative to the exterior surfaces of the unbonded portions 30, and relatively small as compared to the exterior surfaces of the unbonded areas, the unbonded portions of meltspun filaments are prevalent at both of the opposite faces of the nonwoven fabric or wipe 10. The large size and number of exposed, unbonded portions 30 of the meltspun filaments at the opposite faces of the nonwoven fabric or wipe 10 contribute to the nice "hand" of the nonwoven (i.e., favorable qualities perceived by touching the fabric or wipe), and these features also allow the nonwoven fabric or wipe to readily absorb fluid by capillary action. Stated differently, due to the predominant nature of the unbonded portions 30 as compared to the bonded portions 20, the nonwoven fabric or wipe 10 may feel soft, retain a substantial amount of liquid, and still exhibit other desirable characteristics such as, but not limited to, good drape, tensile strength and elongation. For example and as will be discussed in greater detail below, the nonwoven fabric or wipe 10 may be treated in a conventional manner with a conventional surfactant, so that when the nonwoven is applied to water the nonwoven may retain the water in an amount of at least 800% of the weight of the nonwoven. More generally, the nonwoven fabric or wipe 10 may retain the water in an amount of greater than 700% of the weight of the nonwoven. Similarly, the nonwoven fabric or wipe 10 may absorb water more quickly than at least some nonwovens thermally formed between conventional calendering rolls.

The meltspun filaments (e.g., see filaments 44 in FIG. 3) of the nonwoven fabric or wipe 10 may be formed from thermoplastic polymer material(s). More specifically, the meltspun filaments of the nonwoven fabric or wipe 10 may be polypropylene meltspun filaments. However, the meltspun filaments may be formed of any other suitable polymeric materials. As examples, the nonwoven fabric or wipe 10 may have a basis weight of about, or at least about, fifty five grams per square meter (gsm); or about, or at least about, sixty gsm. More, generally, the nonwoven fabric or wipe 10 may have a basis weight less than one hundred grams per square meter. Alternatively, the nonwoven fabric or wipe 10 may have any suitable basis weight.

Figure 3:
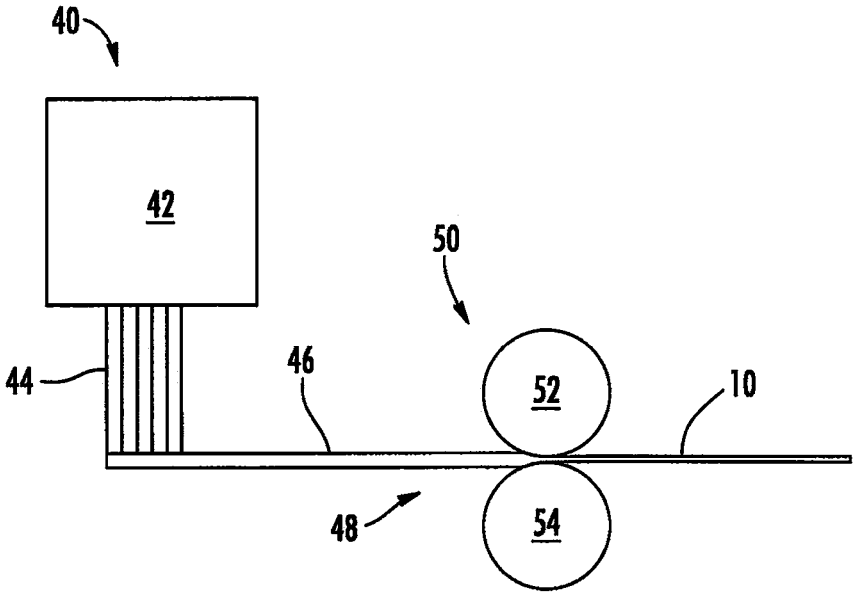
FIG. 3 diagrammatically illustrates at least a portion of a system and process for manufacturing the spunbond nonwoven fabric, or more specifically spunbond nonwoven wipes, in accordance with the exemplary embodiment.

An example of a suitable method of forming the nonwoven fabric and wipes 10 is described in the following with reference to FIG. 3. Generally described, the nonwoven fabric 10 is formed by a spunbond process. More specifically, the manufacture of the nonwoven fabric 10 may begin with a meltspinning process 40, and may be completed with a hot-roll calendering or bonding process 50 that follows the meltspinning process. Thereafter, the fabric 10 may optionally be at least partially cut or scored in a conventional manner (e.g., with suitable cutters and/or scoring rules) so that the fabric comprises a series of wipes, which may optionally be folded and/or otherwise be processed in any suitable conventional manner. For example and as will be discussed again below, the fabric or wipes 10 may optionally be treated in a conventional manner with effective amounts of one or more of any suitable conventional additives, such as, but not limited to, surfactants, cleansing compositions, cosmetic compositions, and/or a wide variety of other additives.

In the meltspinning system/process 40, polymer chips may be heated to a molten state in an extruder/spin-pack assembly 42, or the molten polymer may be provided in any other suitable manner. The molten polymer is then extruded to form a multiplicity of continuous meltspun filaments 44 that are deposited onto a conventional conveying system (not shown)

to form an unbonded precursor web 46. The filaments 44 may be deposited on the conveying system so that, in addition to the filaments extending in the machine direction, portions of the filaments also extend in the cross-machine direction and are in overlapping and underlapping relationships with one another to form the precursor web 46. The filaments 44 may be deposited on the conveying system in a manner such that the precursor web 46 is a single ply precursor web, and the resulting nonwoven fabric or wipe 10 is a single ply nonwoven web, as schematically shown in FIG. 2.

In the bonding system/process 50 of the exemplary embodiment, the bonded portions 20 are formed in the precursor web 46 to transform the precursor web into the nonwoven fabric or wipe 10. In particular, portions of the meltspun filaments 44 of the precursor web 46 are bonded together to form the bonded portions 20. More specifically, the precursor web 46 is calendered or nipped to form the bonded portions 20 and thereby transform the precursor web into the nonwoven fabric or wipe 10. In particular, heat and pressure are applied at predetermined locations so that portions of the meltspun filaments 44 of the precursor web 46 are fused together to form the bonded portions 20. In the bonding system/process 50, the unbonded portions 30 are retained or formed by inhibiting any bonding (e.g. thermal fusing) together of the portions of the meltspun filaments 44 that are located in the unbonded portions. Alternatively and depending upon the circumstances, a slight amount of fusing together of the portions of the meltspun filaments 44 may occur in the unbonded portions 30, but any such secondary fusing in the unbonded portions would typically be orders of magnitude less that the fusing in the bonded portions 20. In the first embodiment, there is a significant reduction in this secondary fusion as compared to at least some prior nonwovens. The low occurrence of secondary fusion in the unbonded portions 30 allows the filaments to maintain their individual freedom of movement.

In the exemplary embodiment, the nip of the bonding system 50 is defined between a patterned roller 52 and a smooth roller 54. The patterned roller 52 includes a pattern of protruding members (not shown) that corresponds to the pattern of the bonded portions 20 in the nonwoven fabric or wipe 10. This correspondence is the result of the pattern of the protruding members of the patterned roller 52 being instrumental in forming the bonded portions 20 in the nonwoven fabric or wipe 10. In this regard, each of the calender rollers 52, 54 may be heated and rotated so that the precursor web 46 is introduced into the entrance of the nip between the rollers, and the nonwoven fabric 10 exits the nip. The distance between adjacent protruding members of the patterned roller 52, the radial distance that the protruding members extend outwardly from a base surface of the patterned roller, and the distance across the nip (e.g., the size of the gap between the tips of the protruding members of the patterned roller and the directly opposing surface of the smooth roller 54) are selected to form and define the (relative) characteristics of the bonded and unbonded portions 20, 30.

More specifically regarding the transformation of the precursor web 46 to the nonwoven fabric 10 that occurs in the nip between the rollers 52, 54, for each portion of the precursor web that is sandwiched (e.g., pinched) in a relatively small gap defined between the tip of a protruding member of the patterned roller 52 and the directly opposite portion of the surface of the smooth roller 54, that portion of the precursor web 46 is transformed into a bonded portion 20 in response to meltspun filaments 44 in that portion being at least partially melted so that they fuse together.

In contrast, for each portion of the precursor web 46 that is positioned in a relatively large gap defined between a nonprotruding portion of the surface of the patterned roller 52 and the directly opposite portion of the surface of the smooth roller 54, that portion of the precursor web 46 remains as, or is transformed into, an unbonded portion 30 in response to a lack of the meltspun filaments 44 in that portion being substantially compressed and/or substantially melted. That is, any melting of the meltspun filaments 44 in the relatively large gaps is very minimal as compared to the melting that occurs in the bonded portions 20. Accordingly, the meltspun filaments 44 do not fuse together in the unbonded portions 30, or any fusing together of the meltspun filaments in the unbonded potions is very minimal as compared to the fusing together that occurs in the bonded portions 20. Stated differently, in each relatively large gap, which is defined between a nonprotruding portion of the surface of the patterned roller 52 and the directly opposite portion of the surface of the smooth roller 54, any pinching of the portion of the precursor web 46 therein is restricted, and heat transfer therein is restricted. As a result, on a microscopic level, there are open spaces between adjacent portions of the meltspun filaments 44 in the unbonded portions 30, so that the unbonded portions 30 are lofty and compressible. The heat transfer may be restricted in the relatively large gaps between the calender rollers 52, 54 due to air being present in the relatively large gaps, and the air having an insulating effect (e.g., a relatively low coefficient of heat transfer). In this regard, the protruding members of the patterned roller 52 are typically sufficiently long so that the relatively large gaps are sufficiently large to result in the unbonded portions 30 being formed therein as described above. In accordance with the first embodiment, the protruding members of the patterned (e.g., engraved) roller 52 extend radially outwardly from the base surface of the patterned roller by greater than 0.6 mm. That is, the protruding members of the patterned roller 52 have a height of greater than 0.6 mm, although any suitable height may be utilized.

The bonding, or more particularly the fusing, of the respective portions of the meltspun filaments 44 that is carried out to form the bonded portions 20, and the contrasting actions or lack of actions for forming the unbonded portions 30, may be carried out in any other suitable manner, such as by a suitable stamping process. Alternatively, both of the rollers 52, 54 may be patterned, with the rollers' protruding members respectively being in collinear tip-to-tip arrangement at the nip.

It is within the scope of this disclosure for the bonded portions 20 to individually define a variety of different shapes, and for the bonded portions to collectively define a variety of different patterns. For example and as mentioned previously, each of the bonded portions 20 of the exemplary embodiment is obround. An obround shape may be characterized as having opposite rounded ends, a length that extends between the opposite ends, and a width that extends crosswise to, and is smaller than, the length. An obround shape may be more generally referred to as an oblong shape that has a length and a width, wherein the width is smaller than the length.

For example and not for the purpose of limiting the scope of the present invention, some aspects of the pattern of the bonded portions 20 of the nonwoven fabric or wipe 10 shown in FIG. 1 are discussed in detail in the following. The pattern of the bonded portions 20 may be described as being formed by first and second units that are arranged in alternating, staggered rows, and the first and second units may more specifically be in the form of intermediate units 22 and annular end units 24.

As another example, the pattern of the bonded portions 20 may be described as being formed by a compound unit that is repeated uniformly, wherein each compound unit includes an intermediate unit 22 positioned between a pair of the annular end units 24. Each of the annular end units 24 includes a curvilinear series, or more specifically an annular series, of the bonded portions 20. In each annular end unit, adjacent bonded portions 20 of the annular end unit are spaced apart from one another and arranged end to end with respect to one another. Each of the intermediate units 22 of the pattern of the bonded portions 20 has a pair of bond portions that are horizontally spaced apart from one another and each extend vertically. The bonded portions 20 of the intermediate units 22 are different from, more specifically smaller than, the bonded portions of the annular end units 24. Alternatively, the bonded portions 20 of the intermediate units 22 may be more similar to, or identical to, the bonded portions of the annular end units 24.

As shown in FIG. 1, the compound units, intermediate units 22 and end units 24 may be characterized as being arranged in linear series, such as linear series that are staggered with respect to one another. As a more specific example, the compound units (e.g., each having an intermediate unit 22 positioned between a pair of annular end units 24) may be characterized as being arranged in vertical or horizontal rows that are staggered.

More specifically and for each of the annular end units 24 of the pattern of the bonded portions 20, starting with the upper bond portion 20 as a first of the bonded portions and proceeding in a clockwise direction, the first bonded portion extends horizontally, the second bonded portion extends obliquely, the third bonded portion extends obliquely, the fourth bonded portion extends horizontally, the fifth bonded portion extends obliquely, and the sixth bonded portion extends obliquely. Accordingly, the lengths of the first and fourth bonded portions 20 extend horizontally; the lengths of the second, third, fifth and sixth bonded portions respectively extend in two different oblique directions relative to the horizontal direction; and the bonded portions of the intermediate units 22 extend vertically. Each of the annular end units 24 is oblong, with both its length and width being larger than each of the length and width of the bond portions 20 that form the annular end unit. The compound units, units 22, 24, bond portions 20 and/or unbonded portions 30 may be configured, shaped and/or sized differently than discussed above.

The nonwoven fabric 10 may be used in many different ways. For example, wipes, such as may be used for cleaning and/or disinfecting, may be formed from (e.g., cut and/or torn from) the nonwoven fabric, such that the nonwoven fabric may also be referred to as a nonwoven wipe 10. The wipes may be rectangular pieces of the nonwoven fabric 10 that has optionally been moistened, coated, enriched and/or impregnated with substance(s) for enhancing the functionality of the wipes. For example, the substances may include cleansing, disinfecting and/or medicating solutions, and/or any other suitable substances that are conventionally included in wipes.

The above examples are in no way intended to limit the scope of the present invention. For example, those of ordinary skill in the art will understand that the nonwoven fabric or wipe 10 and its pattern may be observed in and/or arranged in a variety of different orientations, such that the directional references (e.g., vertical, horizontal, obliquely and clockwise) used in the foregoing were provided for ease of understanding and not for the purpose of limiting the scope of the present invention.

A second embodiment of this disclosure is like the first embodiment, except for variations noted and variations that will be apparent to one of ordinary skill in the art. In accordance with the second embodiment, the precursor web 46 (FIG. 3) is a carded web of suitable staple fibers, and the carded web of suitable staple fibers is calendered or nipped between the rollers 52, 54 as discussed above to form a thermally bonded nonwoven fabric that may optionally be formed into wipes. For example, the staple fibers may be cut from thermoplastic meltspun filaments, or they may be formed in any other suitable manner.

It will be understood by those skilled in the art that while the present disclosure has been discussed above with reference to exemplary embodiments, various additions, modifications and changes can be made thereto without departing from the spirit and scope of the invention as set forth in the claims.

What is claimed is:

1. A nonwoven wipe comprising:

a multiplicity of fibers;

a plurality of bonded portions, the bonded portions being spaced apart from one another, each bonded portion comprising portions of the fibers that are bonded together, and each bonded portion having a thickness extending perpendicularly between opposite faces of the nonwoven wipe;

a plurality of unbonded portions, each unbonded portion comprising portions of the fibers that are not bonded together, and each unbonded portion having a thickness extending perpendicularly between the opposite faces of the nonwoven wipe;

the thicknesses of the unbonded portions being greater than the thicknesses of the bonded portions; and the bonded portions being sized and arranged in a pattern configured so that the unbonded portions occupy more than 5.55 times as much space as the bonded portions in a plan view of an area of a face of the opposite faces of the nonwoven wipe, wherein the area contains more than one hundred of the bonded portions.

2. The nonwoven wipe according to claim 1, wherein the fibers comprise meltspun filaments.

3. The nonwoven wipe according to claim 1, wherein the unbonded portions occupy more than about six times as much space as the bonded portions in the plan view of the area of the face of the nonwoven wipe.

4. The nonwoven wipe according to claim 1, wherein the thicknesses of the unbonded portions are more than twice as large as the thicknesses of the bonded portions.

5. The nonwoven wipe according to claim 1, wherein exterior surfaces of the bonded portions are recessed relative to exterior surfaces of the unbonded portions at each of the opposite faces of the nonwoven wipe.

6. The nonwoven wipe according to claim 1, wherein the unbonded portions are contiguous with one another in the nonwoven wipe.

7. The nonwoven wipe according to claim 1, wherein the opposite faces of the nonwoven wipe are opposite exterior faces of the nonwoven wipe, and the nonwoven wipe is a single ply nonwoven wipe.

8. The nonwoven wipe according to claim 1, wherein each bonded portion comprises portions of the fibers that are thermally fused together.

9. The nonwoven wipe according to claim 1, wherein the nonwoven wipe has a basis weight of at least about fifty five grams per square meter.

10. The nonwoven wipe according to claim 9, wherein the nonwoven wipe has a basis weight of at least about sixty grams per square meter.

11. The nonwoven wipe according to claim 10, wherein the nonwoven wipe has a basis weight of less than one hundred grams per square meter.

12. The nonwoven wipe according to claim 1, wherein the pattern comprises a plurality of units, and each unit comprises an annular series of the bonded portions that are spaced apart from one another.

13. The nonwoven wipe according to claim 12, wherein for each unit:

each of the bonded portions of the unit is oblong, and adjacent bonded portions of the unit are spaced apart from one another and arranged end to end with respect to one another.

14. The nonwoven wipe according to claim 12, wherein the units are arranged in rows.

15. The nonwoven wipe according to claim 12, wherein:

the units are first units;

the pattern comprises a plurality of second units; and each second unit comprises a pair of the bonded portions that are spaced apart from one another.

16. The nonwoven wipe according to claim 15, wherein:

the pattern comprises a plurality of compound units; and each compound unit comprises a second unit of the plurality of second units positioned between a pair of first units of the plurality of first units.

17. The nonwoven wipe according to claim 16, wherein the compound units are arranged in staggered rows.

18. The nonwoven wipe according to 1, wherein:

the plurality of bonded portions comprises first and second pluralities of the bonded portions;

for each bonded portion of the first and second pluralities of bonded portions, the bonded portion has a length and a width that is smaller than the length;

the lengths of the bonded portions of the first plurality extend in a first direction; and the lengths of the bonded portions of the second plurality extend in a second direction that is oblique to the first direction.

19. The nonwoven wipe according to claim 18, wherein the first and second pluralities of the bonded portions are arranged in alternating rows.

20. The nonwoven wipe according to claim 18, wherein for each bonded portion of the first and second pluralities of bonded portions, the bonded portion is obround.

21. The nonwoven wipe according to 18, wherein:

the plurality of bonded portions further comprises a third plurality of the bonded portions;

for each bonded portion of the third plurality of bonded portions, the bonded portion has a length and a width that is smaller than the length; and the lengths of the bonded portions of the third plurality extend in a third direction that is oblique to each of the first and second directions.

22. The nonwoven wipe according to 21, wherein:

the plurality of bonded portions further comprises a fourth plurality of the bonded portions;

for each bonded portion of the fourth plurality of bonded portions, the bonded portion has a length and a width that is smaller than the length; and the lengths of the bonded portions of the fourth plurality extend in a fourth direction that is perpendicular to the first direction.

23. A nonwoven wipe consisting essentially of:

a multiplicity of filaments;

a plurality of bonded portions, each bonded portion consisting essentially of portions of the filaments that are thermally fused together; and a plurality of unbonded portions, each unbonded portion consisting essentially of portions of the filaments that are not bonded together, wherein the bonded portions are spaced apart from one another, each bonded portion has a thickness extending perpendicularly between opposite faces of the nonwoven wipe, each unbonded portion has a thickness extending perpendicularly between the opposite faces of the nonwoven wipe, the thicknesses of the unbonded portions are greater than the thicknesses of the bonded portions, the bonded portions are sized and arranged in a pattern configured so that the unbonded portions occupy more than about six times as much space as the bonded portions in a plan view of an area of a face of the opposite faces of the nonwoven wipe, and the area contains more than one hundred of the bonded portions.

24. The nonwoven wipe according to claim 23, wherein the filaments comprise meltspun filaments.

* * * * *